US007360794B2

(12) United States Patent
Kohama

(10) Patent No.: US 7,360,794 B2
(45) Date of Patent: Apr. 22, 2008

(54) BUCKLE APPARATUS AND SEAT BELT APPARATUS

(75) Inventor: Shigeru Kohama, Tokyo (JP)

(73) Assignee: Takata Corporation (JP)

( * ) Notice: Subject to any disclaimer, the term of this patent is extended or adjusted under 35 U.S.C. 154(b) by 0 days.

(21) Appl. No.: 11/383,051

(22) Filed: May 12, 2006

(65) Prior Publication Data

US 2006/0261588 A1 Nov. 23, 2006

(30) Foreign Application Priority Data

May 19, 2005 (JP) ..... 2005-147165

(51) Int. Cl.
*B60R 22/00* (2006.01)

(52) U.S. Cl. ..... 280/801.1

(58) Field of Classification Search ..... 280/801.1; 24/635, 636; 340/425.5, 426.15
See application file for complete search history.

(56) References Cited

U.S. PATENT DOCUMENTS

| | | | | |
|---|---|---|---|---|
| 4,181,832 | A | | 1/1980 | Ueda |
| 4,928,366 | A | | 5/1990 | Ballet |
| 5,176,439 | A | * | 1/1993 | Kawamura ..... 362/108 |
| 5,181,773 | A | | 1/1993 | Colvin |

FOREIGN PATENT DOCUMENTS

| | | | |
|---|---|---|---|
| FR | 2553637 A | * | 4/1985 |
| JP | 5-228008 | | 7/1992 |
| JP | 5-15813 | | 3/1993 |
| JP | 5-53508 | | 7/1993 |

OTHER PUBLICATIONS

A search report dated Sep. 18, 2006, from the European Patent Office in corresponding European Application No. 06006004.3-2314.

* cited by examiner

*Primary Examiner*—Faye M. Fleming
(74) *Attorney, Agent, or Firm*—Fitch, Even, Tabin & Flannery

(57) ABSTRACT

A buckle apparatus capable of easily securing mounting space of a holding board preventing the buckle apparatus from bulking and realizing easiness for securing internal space of the buckle apparatus is provided. In one form, the buckle apparatus is provided with covers including an opening portion at one side, a buckle portion being provided in the covers and being engaged with a tongue of a seat belt inserted through the opening portion, a slimline LED light source provided in the vicinity of the opening portion, holding boards, provided in the covers, in a standing manner such that at least a light source holding portion for holding an LED light source is arranged in a direction to intersect with an inserting direction of the tongue.

18 Claims, 9 Drawing Sheets

NON-LATCHED STATE

LATCHED STATE

BUCKLE APPARATUS AND SEAT BELT APPARATUS

FIELD OF THE INVENTION

The present invention relates to a buckle apparatus, and more particularly to a buckle apparatus provided with an illuminating function, and a seat belt apparatus having the buckle apparatus.

BACKGROUND OF THE INVENTION

Hitherto, in a seat belt apparatus for use in a motor vehicle, or the like, a buckle apparatus for fixing an end portion of webbing (belt) that keeps an occupant under restraint, or the buckle apparatus for fixing a tongue being provided at a turned back end portion of the webbing to a motor vehicle is provided.

FIGS. 8(*a*), 8(*b*), and 9 illustrate an example of such a buckle apparatus in a conventional technology, in which FIG. 8(*a*) is a longitudinal cross-section illustrating a buckle apparatus where a tongue is in a non-latched (disengaged) state with the buckle apparatus, FIG. 8(*b*) is a longitudinal cross-section illustrating the buckle apparatus where the tongue is in a latched (engaged) state with the buckle apparatus, and FIG. 9 is an exploded perspective view illustrating an entire structure of the buckle apparatus. In addition, part of constituting elements shown in FIG. 9 is omitted in FIGS. 8(*a*) and 8(*b*) to avoid complication of the drawings.

(1) Entire Construction of the Buckle Apparatus

In FIGS. 8(*a*), 8(*b*), and 9, a buckle apparatus 1 is having following elements, i.e., a base 2 formed of a U-shaped frame having two of a left and a right side walls, 2*a* and 2*b*, and a bottom portion 2*c*, a latch member 4 being rotatably supported by means of both of the side walls, 2*a* and 2*b*, of the base 2, and capable of being latched (engaged) with a tongue 3 that serves as a member for a belt, which is to be latched, a slider (locking member) 5 that is movably supported by means of the latch member 4 for relative movement on an upper face of the latch member 4, and that prevents the latch member 4 from moving in a releasing direction for a latched state of the latch member 4 when the tongue 3 and the latch member 4 are latched with each other, a slider spring 6 that always causes the slider 5 to be biased toward the latch member 4 by means of being compressed between the slider 5 and the latch member 4, a locking pin 7 being rotatably supported by means of holes, 2*d* and 2*e*, of both of the side walls, 2*a* and 2*b*, of the base 2, which presses (locks) an upper face of the slider 5 that prevents the latch member 4 from moving in the releasing direction for the latched state of the latch member 4 when the tongue 3 and the latch member 4 are latched with each other, a release button (operation member) 8 movably provided in a longitudinal direction at both of the side walls, 2*a* and 2*b*, of the base 2, an inertia lever 9 positioned between a release button 8 and the latch member 4 and being rotatably supported by means of grooves, 2*f* and 2*g*, of both of the side walls, 2*a* and 2*b*, an ejector 10 being slidably provided in a longitudinal direction of the base 2 at a bottom portion 2*c* of the base 2 and separating the tongue 3 from the buckle apparatus 1, an ejector spring 11 that always keeps the ejector 10 being biased in a direction for the tongue 3 to be separated from the buckle apparatus 1, and covers (an upper cover UC and a lower cover LC) that include these elements described above in a manner so as to cover from above and below.

The latch member 4 is provided with rotating shafts, 4*a* and 4*b* and the rotating shafts, 4*a* and 4*b*, are rotatably supported by means of supporting grooves, 2*h* and 2*i*, formed in both of the side walls, 2*a* and 2*b*, of the base 2. In this case, the latch member 4 is biased in a clockwise direction in the drawings by means of the slider spring 6, in the disengaged (non-latched) state shown in FIG. 8(*a*), and the latch member 4 is biased also in the clockwise direction in the drawings by means of the ejector spring 11 in the latched state, shown in FIG. 8(*b*). As a result, the latch member 4 is always biased by means of either one of two springs, 6 and 11. Further, the latch member 4 is provided with a pair of arms, 4*d* and 4*e*, which is extended from the rotation shafts, 4*a* and 4*b*, each of tip end portions of which serves as portions, 4*d*1 and 4*e*1, to be pressed. Both of these portions, 4*d*1 and 4*e*1, to be pressed are respectively constructed to be capable of being pressed rightward in FIG. 8(*a*) by means of pressing portions, 10*a* and 10*b* (shown in FIG. 9), of the ejector 10 at a right end thereof, as described later.

The slider 5 is provided with a protruding shaft 5*a* at a center thereof extending in a longitudinal direction of the buckle apparatus 1 and the protruding shaft 5*a* is penetrating through a hole 4*c* of the latch member 4. In addition, the protruding shaft 5*a* is fit into the slider spring 6 and the slider spring 6 is compressed by being sandwiched between the latch member 4 and the slider 5. Further, the slider 5 is provided with a pair of left and right engaging shafts, 5*b* and 5*c*.

The pair of the engaging shafts, 5*b* and 5*c* are respectively engaged and supported by means of engaging grooves, 2*j* and 2*k*, respectively formed at both of the side walls, 2*a* and 2*b* of the base 2, and are protruding outward in a predetermined amount from both of the side walls, 2*a* and 2*b*. In this case, both of the engaging grooves, 2*j* and 2*k*, respectively having first groove portions, 2*j*1 and 2*k*1, both of which are extending in a longitudinal direction (namely, the moving direction of the release button 8) of the buckle 1, and second groove portions, 2*j*2 and 2*k*2, extending upward in a sloping manner from these first groove portions, 2*j*1 and 2*k*1, in an opening manner. Further, the engaging shafts, 5*b* and 5*c* of the slider 5 are respectively configured to be movable along the first groove portions, 2*j*1 and 2*k*1, in usual operation, and are configured to be movable along the first groove portions, 2*j*1 and 2*k*1, and the second groove portions, 2*j*2 and 2*k*2, in an unusual operation, i.e., when the latched state is forcibly released.

On the other hand, the side walls, 2*a* and 2*b*, of the buckle apparatus 1 including each of the grooves and the holes have line symmetry at a center line in a longitudinal direction of the buckle apparatus 1.

The release button 8 is provided with a left and a right side walls, 8*a* and 8*b*, extending in a longitudinal direction of the buckle apparatus 1, and a left and a right protruding portions 8*c* (although only one protruding portion is shown and the other protruding portion is not shown, both of the protruding portions are denoted by 8*c*, as a matter of convenience for later explanation.) extending in a longitudinal direction of the buckle apparatus 1 are respectively provided between the side walls, 8*a* and 8*b*, as shown in FIG. 9. A pressing portion 8*f* that is having a vertical face (in a similar manner, both of the pressing portions are hereinafter denoted by 8*f*.), which presses each of the engaging shafts, 5*b* and 5*c*, of the slider 5 so as to move the same in a releasing direction when the releasing button 8 is moved in a releasing direction, is formed in each of the internal faces of both of the side walls, 8*a* and 8*b*.

On the other hand, similar to the side walls, 2*a* and 2*b*, of the buckle apparatus 1, both of the side walls, 8*a* and 8*b*, of the release button 8 have line symmetry at the center line in a longitudinal direction of the buckle apparatus 1.

The inertia lever 9 is provided with a pair of left and right rotation shafts, 9*a* and 9*b*, and these rotation shafts, 9*a* and 9*b*, are rotatably fit into the grooves, 2*f* and 2*g*, of both of the side walls, 2*a* and 2*b*, of the base 2. Further, the inertia lever 9 is provided with a lever-side engaging connecting portion 9*c* formed of a round pin-like shape having a round cross-section.

(2) Basic Motion of the Buckle Apparatus

Next, a latching motion of the buckle apparatus 1 with the tongue 3 in the thus constructed present embodiment will be explained.

In the non-latched state of the buckle apparatus 1 where the tongue 3 is not inserted thereto, a position of the ejector 10 is set to that of a leftmost limit by means of spring force of the ejector spring 11, as shown in FIG. 8(*a*). In the leftmost limit position of the ejector 10, the latch member 4 is rotated in an upper direction (in a clockwise direction from the latched state) in relationship among the slider 5, the locking pin 7, and the slider spring 6. At this moment, the slider 5 is disengaged from the locking pin 7 and is positioned to be upwardly rotated. As a result, an upper face of the latch member 4 is kept in contact with a lower face of the locking pin 7. In this state, a joggle portion 4*f* of the latch member 4 is moved away from the inserting path of the tongue 3 and the latch member 4 is set to be at a non-latching position where the joggle portion 4*f* is not latched with the tongue 3.

When the tongue 3 is inserted through an opening (tongue insertion inlet) 1*a* that is provided at one side end portion (left end portion in the middle in FIGS. 8(*a*) and 8(*b*)) of the upper cover UC of the buckle apparatus 1, in the non-latched state of the buckle apparatus 1, a right end of the tongue 3 is caused to be in contact with a left end of the ejector 10 and the ejector 10 is pressed rightward. Then, because the ejector 10 moves rightward compressing the ejector spring 11 corresponding to an inserting amount of the tongue 3, a suppressing portions 10*a* and 10*b* of the ejector 10 presses the portions, 4*d*1 and 4*e*1, of the latch member 4 to be pressed, in a rightward direction and thereby the latch member 4 is downwardly (in a counterclockwise direction) rotated. Consequently, the joggle portion 4*f* of the latch member 4 proceeds to a moving path of the tongue 3 and is fit into a latching hole 3*a* of the tongue 3. Accordingly, the latch member 4 is in a latching position. Further, when inserting force of the tongue 3 is released, the ejector 10 presses the right end of the tongue 3 by means of spring force of the ejector spring 11; a right end portion of the latching hole 3*a* of the tongue 3 is engaged with the joggle portion 4*f*; the tongue 3 is latched with the buckle apparatus 1; and the tongue 3 and the buckle apparatus 1 are caused to be in a latched state, shown in FIG. 8(*b*).

At this moment, the slider 5 proceeds to a position below the locking pin 7 by means of the spring force of the slider spring 6, and an upper face of the slider 5 is pressed by the locking pin 7. Accordingly, the latch member 4 cannot be pulled out from the latching hole 3*a* of the tongue 3 and the latched state of the tongue 3 and the buckle apparatus 1 are firmly maintained. This is because the slider 5 holds the latch member 4 at a latching position, shown in FIG. 8(*b*).

When the release button 8 is pressed rightward so as to release the latched state of the tongue 3 and the buckle apparatus 1, shown in FIG. 8(*b*), the release button 8 is moved rightward. Further, a pressing portion 8*f* of the release button 8 presses each of the engaging shafts, 5*b* and 5*c*, of the slider 5 rightward, and the slider 5 is moved rightward, i.e., in a direction toward the latch member 4, against the biasing force of the slider spring 6. Then, the engaging shafts, 5*b* and 5*c*, of the slider 5 are displaced from the first groove portions, 2*j*1 and 2*k*1, and a left end upper face of the slider 5 is displaced from a lower face of the locking pin 7. As a result, the slider 5 is caused not to be pressed by means of the locking pin 7.

Then, the slider 5 and the latch member 4 are rotated in a clockwise direction and the joggle portion 4*f* is moved upward. The ejector 10 strikes up the latch member 4 via the tongue 3; the latch member 4 and the slider 5 are further rotated in a clockwise direction around the rotation shafts, 4*a* and 4*b*, as a rotation center; the joggle portion 4*f* is displaced away from the latching hole 3*a* of the tongue 3; and at the same time, the tongue 3 is pushed out in a left direction. This is because the ejector 10 is biased in a direction for releasing the latched state by the spring force of the ejector spring 11.

As shown in FIG. 8(*a*), when an upper face of a joggle portion 4*f* side of the latch member 4 is caused to be in contact with the locking pin 7, the rotation of the latch member 4 and the slider 5 in a clockwise direction is stopped. At this moment, a left end of the slider 5 is caused to be in contact with the locking pin 7 by means of the tension force of the slider spring 6. Finally, the ejector 10 is located at a leftmost limit position, and the latch member 4 is located at a non-latching position. Consequently, the buckle apparatus 1 is in the non-latched state where the tongue 3 is displaced.

In addition, for switching the aforementioned positions of the buckle apparatus 1 and the tongue 3, from the latched position to the non-latched position, and vice versa, a magnet 50 (a permanent magnet) for detecting the latched state is provided in the slider 5, as shown in FIG. 9. Correspondingly, a magnet sensor 100 for generating electromotive force by means of a magnetic field of the aforementioned magnet 50 is provided in a sensor holder 60 whose claw portions, 60*a* and 60*b*, are latched with a engaging holes, 2*p* and 2*q*, of both of the side walls, 2*a* and 2*b*, of the base 2. The magnet sensor 100 detects whether the slider 5 is contiguous to (corresponding to the non-latched state) or distant from (corresponding to the latched state) the magnet sensor 100 on the basis of that the magnet field is small or large, and outputs corresponding current value, for example.

On the other hand, in such a buckle apparatus 1, particularly, at a nighttime or the like, when an inside of a room of the motor vehicle is in a state of a darkroom, a buckle apparatus provided with an illuminating function to ease recognition for a position of the buckle apparatus 1, or to ease recognition for an inserting opening of the buckle apparatus 1 for inserting the tongue 3, is known (for example, refer to Japanese Unexamined Utility Model Registration Application Publication No. 5-53508).

FIG. 7 is a perspective view illustrating a built-in illumination apparatus for the buckle apparatus of the aforementioned conventional technology.

In an illumination apparatus, shown in FIG. 7, a printed circuit board 20 is disposed at the aforementioned lower cover LC. A plurality of conductive wiring portions 21 are formed in the printed circuit board 20. Further, a harness 22 connected to a controller (not shown), an LED 23 for illuminating the vicinity of an insertion inlet for the tongue 3, and a resistor 24 for setting electric current supplied to the LED to a predetermined value are connected to the wiring portion 21, by means of soldering.

The LED 23 is disposed in the vicinity of the insertion inlet for the tongue 3, and for example, a portion around the insertion inlet for the tongue 3 is illuminated by emitting light when the controller detects that an occupant is seated in a seat.

In addition, as the upper face view is shown in FIG. 6(*a*) and the side face view is shown in FIG. 6(*b*), a reflector (lens) 25 for diffusing and leading light flux of the illumination emitted from the LED 23 is usually disposed at a front face of the LED 23.

On the other hand, in the thus constructed buckle apparatus 1, because a printed circuit board 20 provided with an LED 23 is disposed at almost all over the lower cover LC, large space is required to be secured. Therefore, space in the upper cover UC and the lower cover LC for the members to be mounted on (mounting space) is limited. In other words, the mounting space in the upper cover UC and the lower cover LC for the members other than that described above, for example, a detection system, such as the aforementioned magnet sensor 100 or the like, a drive system, such as the latch member 4, the slider 5, and the like, and other system is compressed. Consequently, it is likely to decrease flexibility for designing.

SUMMARY OF THE INVENTION

Accordingly, an object of the present invention is to provide a buckle apparatus and a seat belt apparatus capable of improving the flexibility for designing the space in the cover, while being provided with an illuminating function.

To achieve the above-described object, a buckle apparatus according to one preferred form of the invention is characterized in including a cover having an opening portion at one side, a buckle portion provided in the cover and engaged with a tongue of a seat belt inserted through the opening portion, a light source provided in the vicinity of the opening portion, a holding board provided in the cover in a standing manner such that at least a light source holding portion for holding the light source is arranged in a direction to intersect with an inserting direction of the tongue.

The buckle apparatus according to a second form is characterized in that the holding board is provided in a standing manner such that at least the light source holding portion is slanting at substantially 45° in relation to the inserting direction of the tongue.

The buckle apparatus according to a third form is characterized in that the holding board is provided in a standing manner such that at least the light source holding portion is slanting at substantially 60° in relation to the inserting direction of the tongue.

The buckle apparatus according to a fourth form is characterized in that the holding board is provided in a standing manner such that at least the light source holding portion is arranged in a direction to intersect at substantially right angles in relation to the inserting direction of the tongue.

The buckle apparatus according to a fifth form is characterized in that the holding board is inserted and held along a guide groove provided in the cover.

The buckle apparatus according to a sixth form is characterized in that the holding boards are paired in a manner so as to sandwich the opening portion in between and each of the holding boards is electrically connected together by means of a lead wire.

The buckle apparatus according to a seventh form is characterized in that the light source is constituted by a chip-type LED.

A seat belt apparatus according to another preferred form of the invention is characterized in including webbing for keeping an occupant under restraint, a retractor apparatus capable of retracting the webbing, a buckle apparatus connected to a member at a fixing side, and a tongue provided in the webbing, in which the buckle apparatus includes a cover having an opening portion at one side, a buckle portion provided in the cover and engaged with the tongue being inserted through the opening portion, a light source provided in the vicinity of the opening portion, and a holding board provided in the cover in a standing manner such that at least a light source holding portion for holding the light source is arranged in a direction to intersect with an inserting direction of the tongue.

In a buckle apparatus according to the present invention, because a light source is provided in the vicinity of the opening portion and at least a light source holding portion of the holding board is provided in a standing manner being arranged in a direction to intersect with an inserting direction of the tongue, space can be formed at a rear side (opposite side to the light source) of the light source holding portion. As a result, designing flexibility for the space in the cover can be improved.

In the buckle apparatus according to the second form, a standing angle of the light source holding portion is formed to be slanting at 45° in relation to an inserting direction of the tongue and thereby the mounting space in each of the inserting direction of the tongue and a direction to be intersecting therewith can be divided into halves.

In the buckle apparatus according to the third form, a standing angle of the light source holding portion is formed to be slanting at 60° in relation to the inserting direction of the tongue and thereby relatively large space can be secured at a rear side of the light source holding portion.

In the buckle apparatus according to the fourth form, a standing angle of the light source holding portion is formed to be 90° (right angles) in relation to the inserting direction of the tongue and thereby largest space can be secured at a rear side thereof.

In the buckle apparatus according to the fifth form, the holding board is inserted and held along a guide groove provided in the main body of the buckle apparatus and thereby the holding board can be easily held.

In the buckle apparatus according to the sixth form, the holding board is paired in a manner so as to sandwich the opening portion in between and each of the holding boards is electrically connected together by means of a lead wire and thereby the electric connection can be performed without disturbing the opening portion.

In the buckle apparatus according to the seventh form, the light source is constituted by a chip-type LED and is thereby further contributed to a space saving for the space in a belt inserting direction.

A seat belt apparatus according to the other preferred form of the invention is provided with webbing for keeping an occupant under restraint, a retractor apparatus capable of retracting the webbing, a buckle apparatus connected to a member at a fixing side, and a tongue provided in the webbing, in which the buckle apparatus includes a cover having an opening portion at one side, a buckle portion provided in the cover and engaged with the tongue being inserted through the opening portion, a light source provided in the vicinity of the opening portion, and a holding board provided in the cover in a standing manner such that at least a light source holding portion for holding the light source is arranged in a direction to intersect with an inserting direction of the tongue, and accordingly, a seat belt apparatus provided with a buckle apparatus whose designing flexibility for the space in an inner part of the cover is improved can be provided.

DETAILED DESCRIPTION OF THE PREFERRED EMBODIMENTS

A buckle apparatus and a seat belt apparatus of the present invention will be explained referring to FIGS. 1 through 6.

Figure 1:
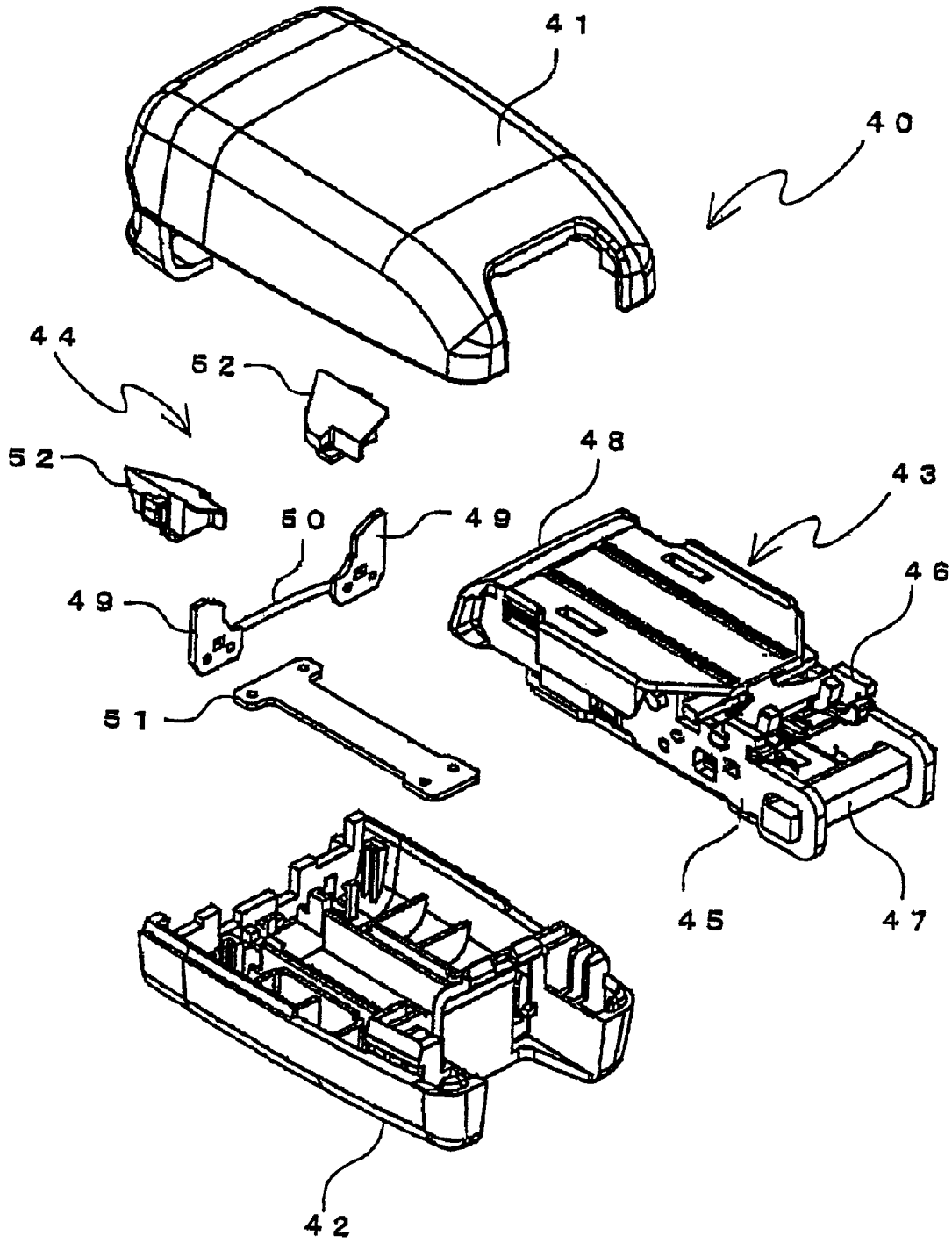
FIG. 1 is an exploded perspective view illustrating a buckle apparatus with respect to the present invention.
Figure 2:
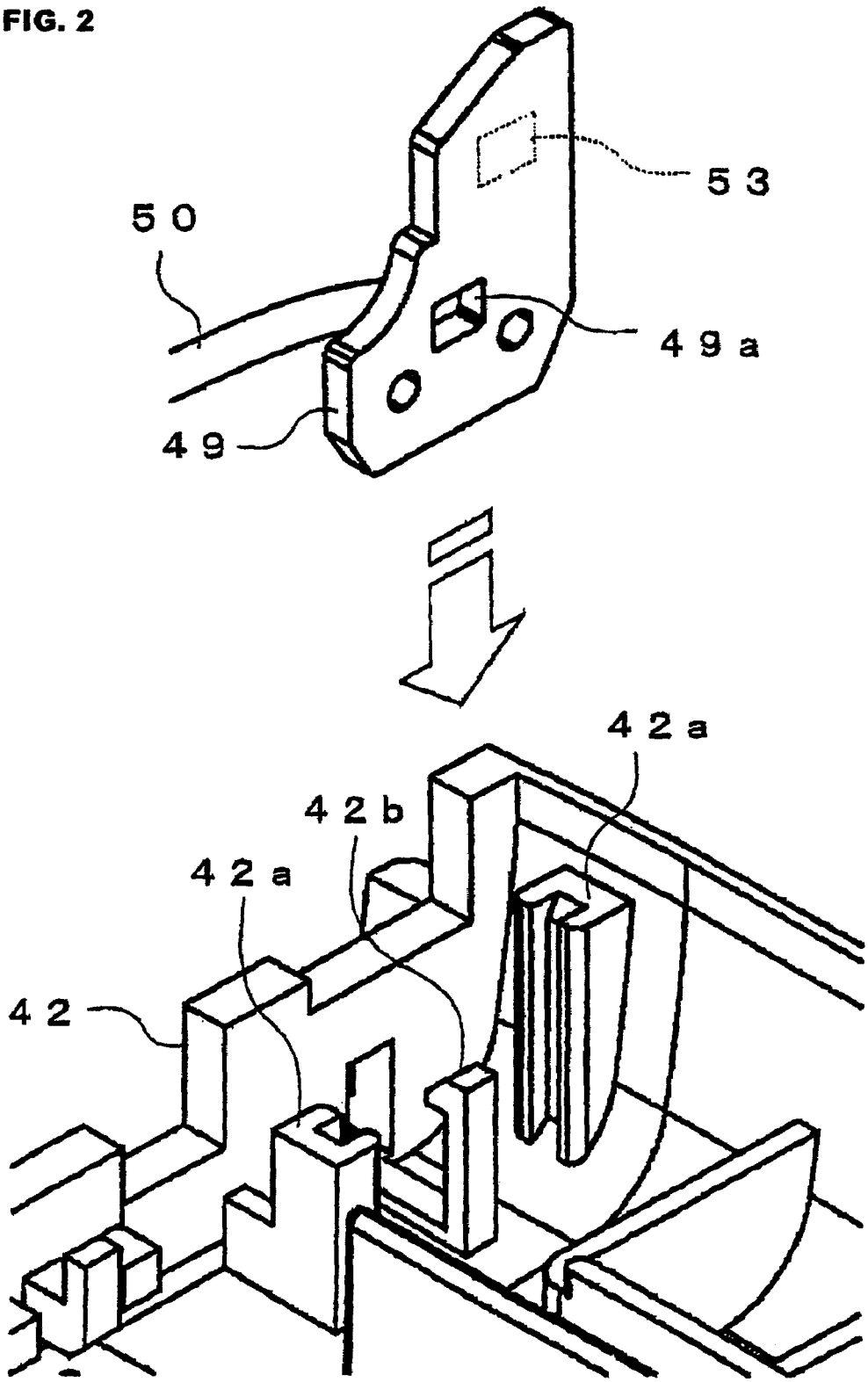
FIG. 2 is an enlarged exploded perspective view of a main part of the buckle apparatus with respect to the present invention.
Figure 3A:
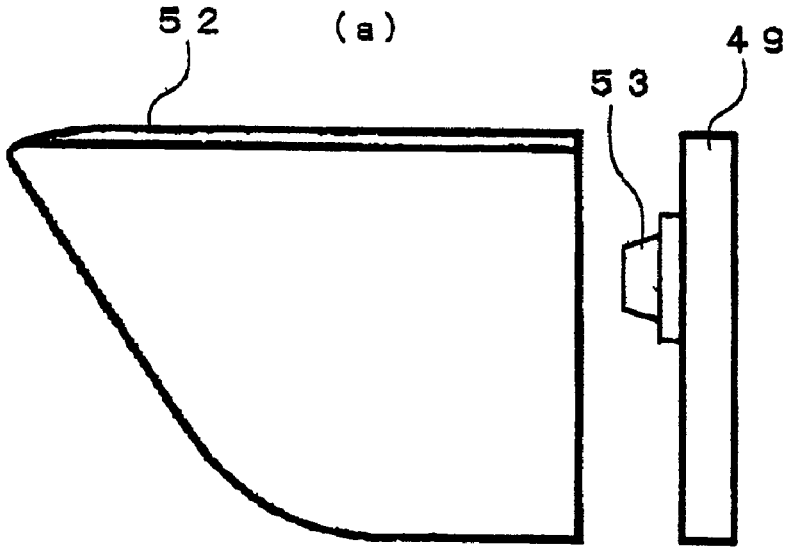
FIG. 3(*a*) is plan view illustrating a relationship between a reflector and a slimline LED light source of the buckle apparatus with respect to the present invention, and FIG. 3(*b*) is a side elevation illustrating a relationship between the reflector and the slimline LED light source of the buckle apparatus with respect to the present invention.
Figure 3B:
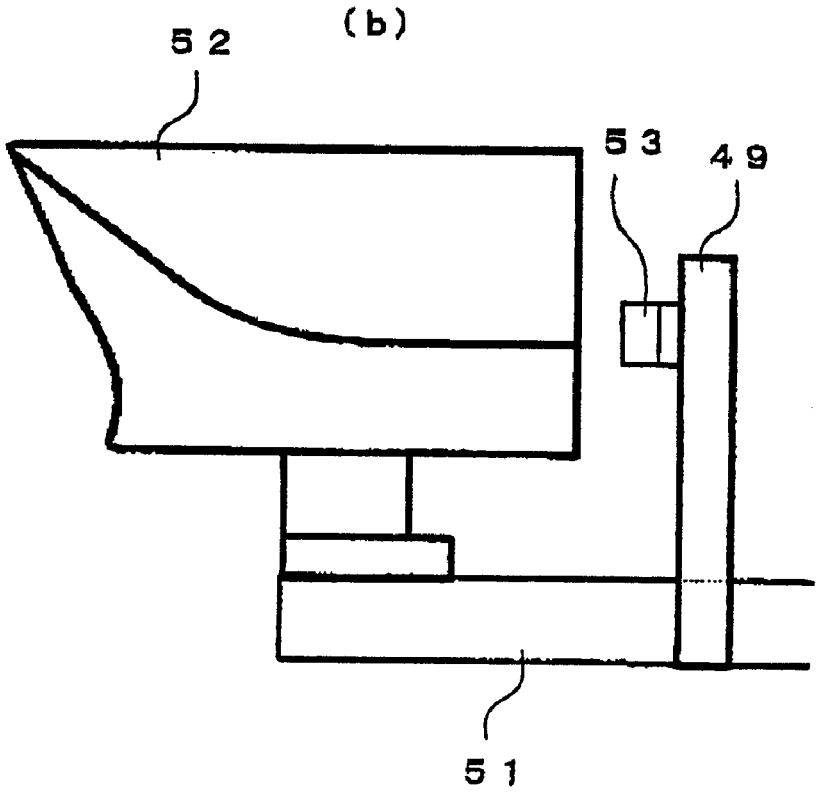
Figure 4A:
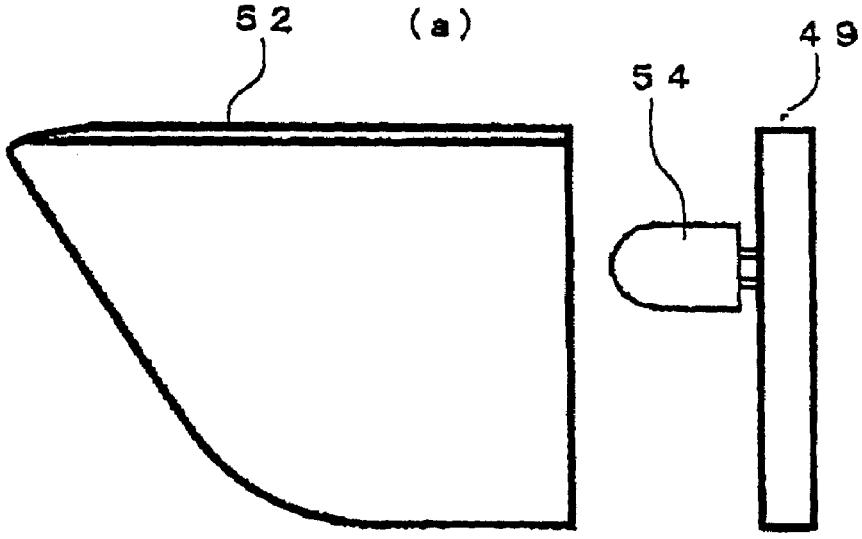
FIG. 4(*a*) is a plan view illustrating a relationship between a reflector and an LED light source of the buckle apparatus with respect to the present invention, and FIG. 4(*b*) is a side elevation illustrating a relationship between the reflector and the LED light source of the buckle apparatus with respect to the present invention.
Figure 4B:
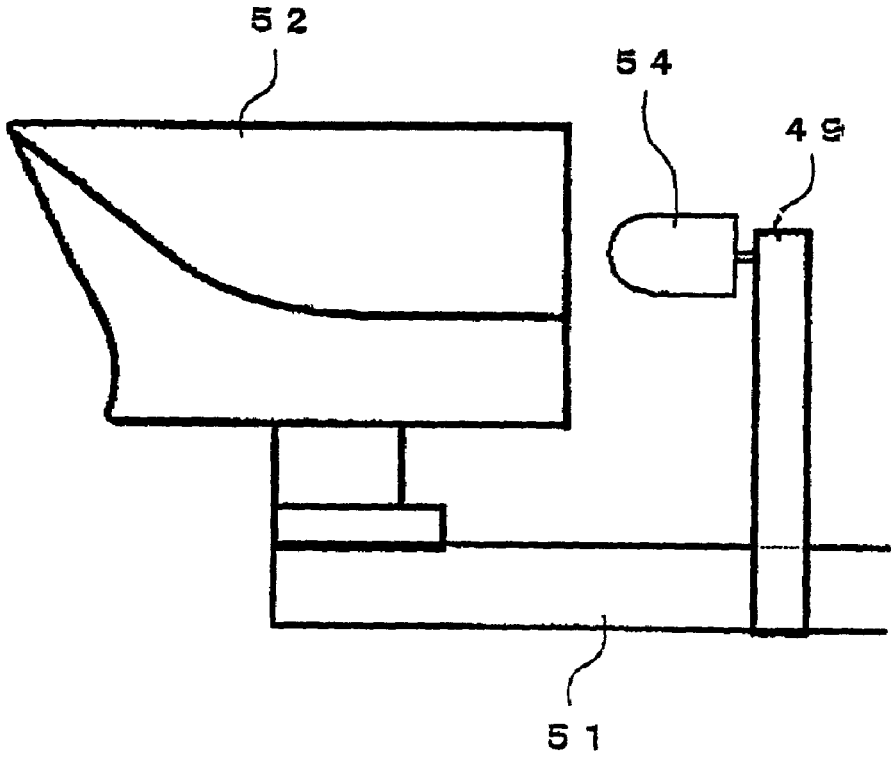

FIG. 1 is an exploded perspective view illustrating a buckle apparatus with respect to the present invention; FIG. 2 is an enlarged exploded perspective view illustrating a main part of the buckle apparatus with respect to the present invention; FIG. 3(*a*) is a plan view illustrating a relationship between a reflector and a slimline LED light source of the buckle apparatus with respect to the present invention; FIG. 3(*b*) is a side elevation illustrating the relationship between the reflector and the slimline LED light source of the buckle apparatus with respect to the present invention; FIG. 4(*a*) is a plan view illustrating a relationship between a reflector and an LED light source of the buckle apparatus with respect to the present invention; FIG. 4(*b*) is a side elevation illustrating a relationship between the reflector and the LED light source of the buckle apparatus with respect to the present invention; and FIG. 5 is a perspective view illustrating a seat belt apparatus for use in a driver's seat of a motor vehicle in a using state, showing an example of the seat belt apparatus.

Figure 5:
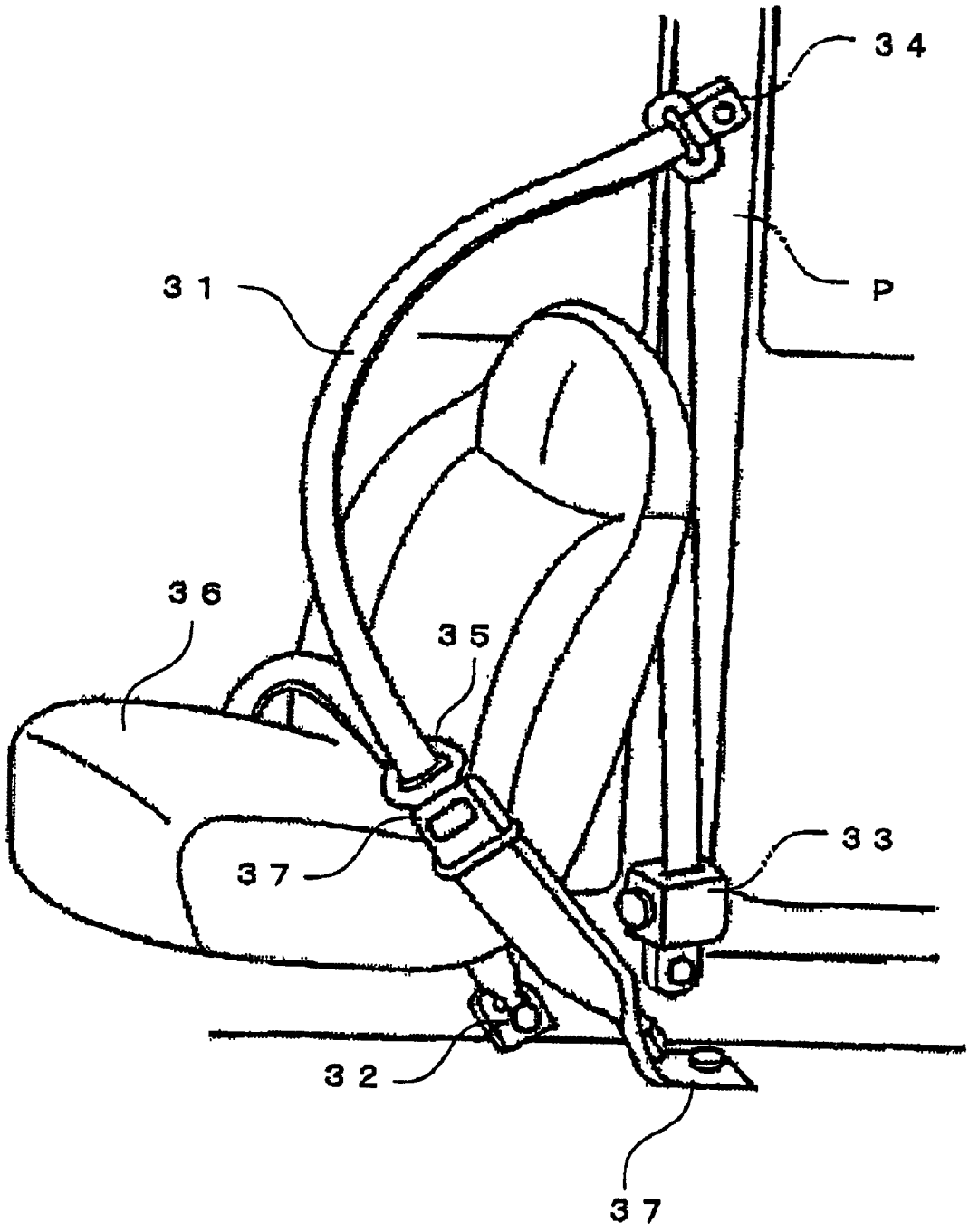
FIG. 5 is perspective view illustrating a seat belt apparatus for use in a driver's seat of a motor vehicle in a using state, showing an example of the seat belt apparatus.
Figure 6A:
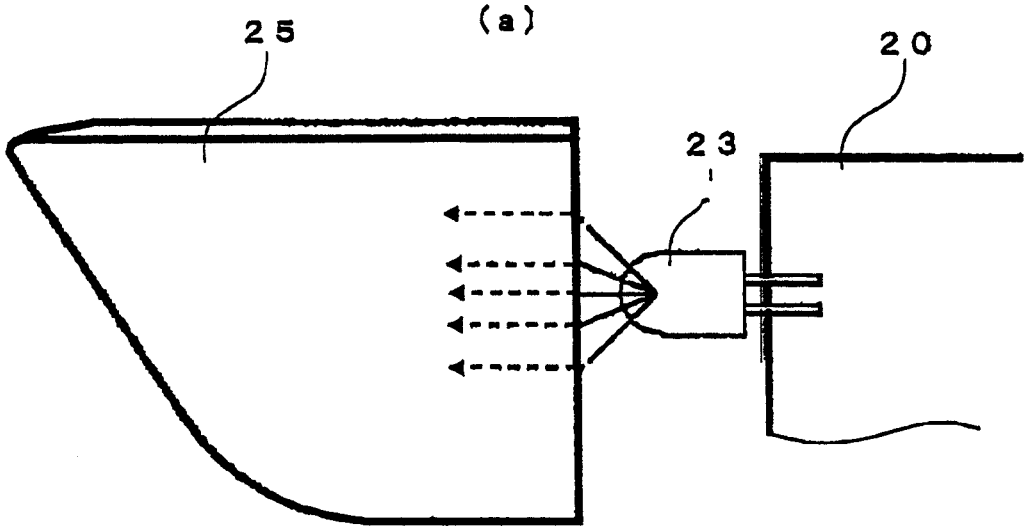
Prior Art FIG. 6(a)
FIG. 6(*a*) is a perspective view illustrating a relationship between a reflector and an LED light source of a conventional buckle apparatus, and FIG. 6(*b*) is a side elevation illustrating a relationship between the reflector and the LED light source of the conventional buckle apparatus.
Figure 6B:
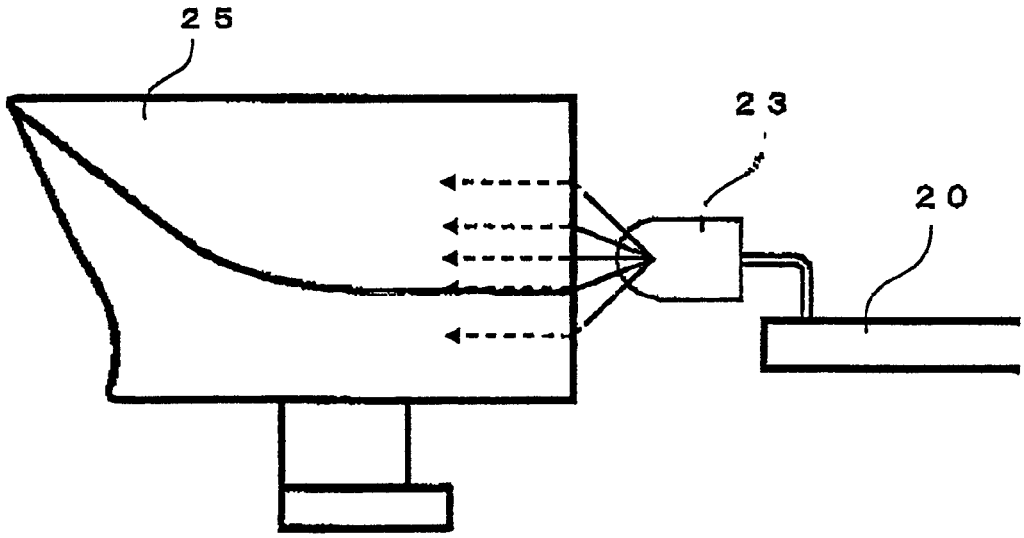
Prior Art FIG. 6(b)
Figure 7:
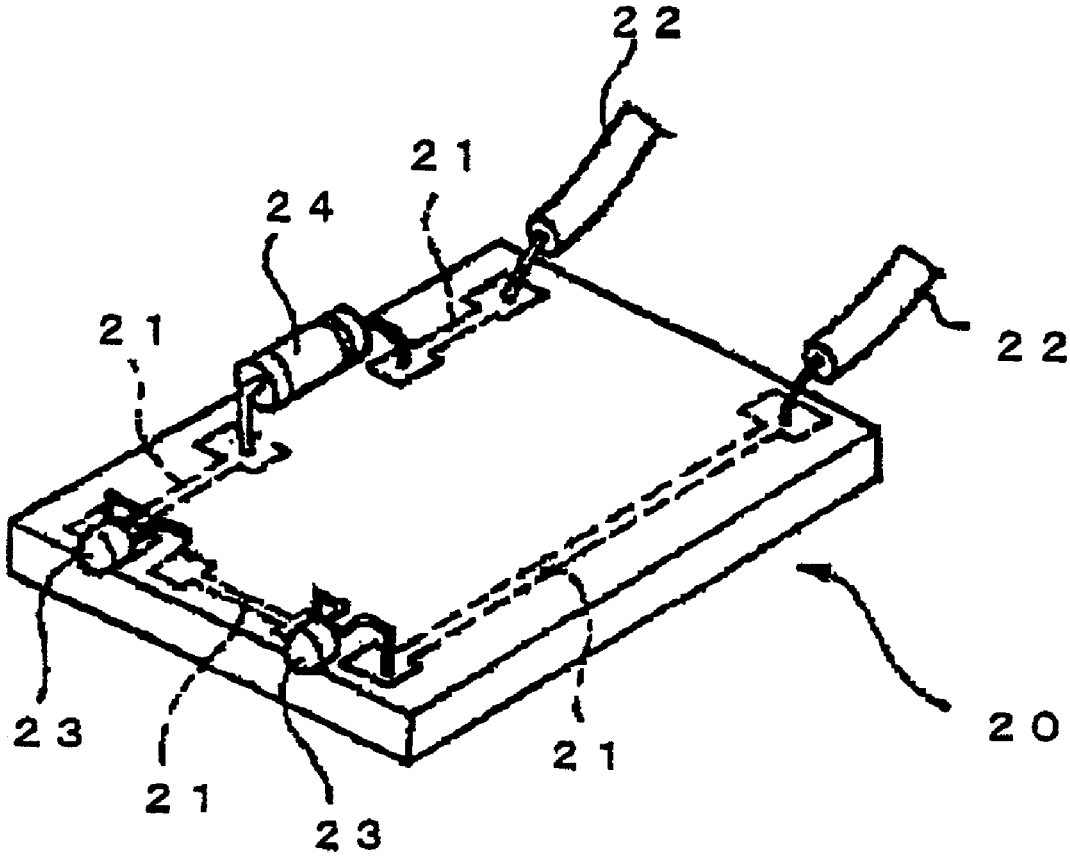
Prior Art FIG. 7
FIG. 7 is a perspective view illustrating an illumination apparatus being built in the conventional buckle apparatus.
Figure 8A:
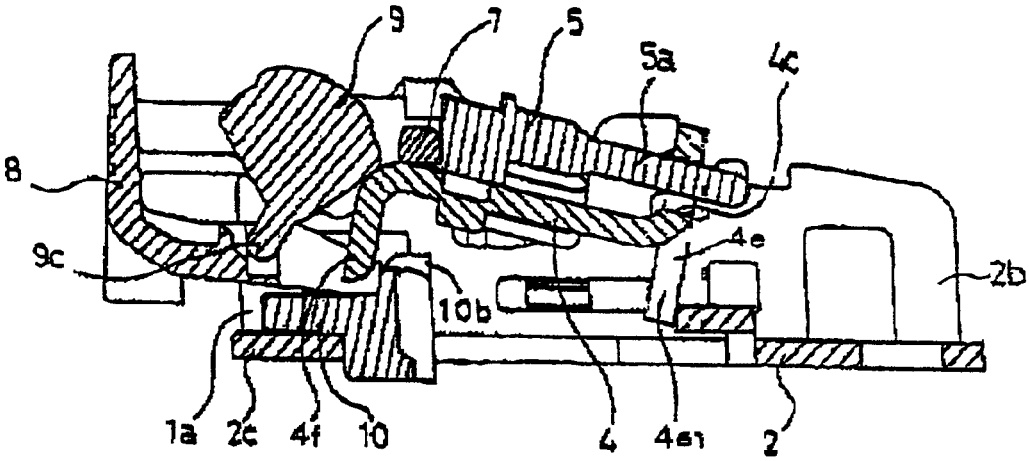
FIG. 8(a) Prior Art
FIG. 8(*a*) is a longitudinal cross-section illustrating a conventional buckle apparatus showing a non-latched (disengaged) state with the tongue, and FIG. 8(*b*) is a longitudinal cross-section illustrating a conventional buckle apparatus in a latched (engaged) state with the tongue.
Figure 8B:
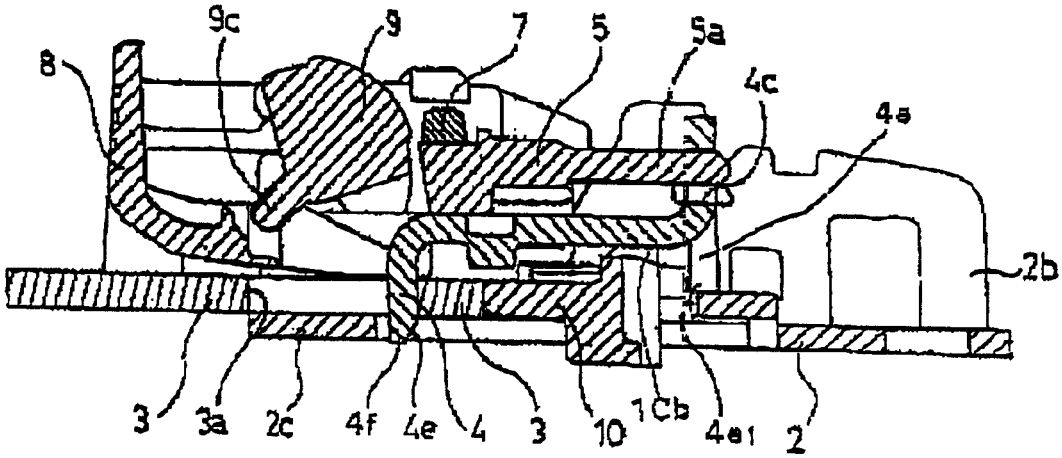
Prior Art FIG. 8(b)
Figure 9:
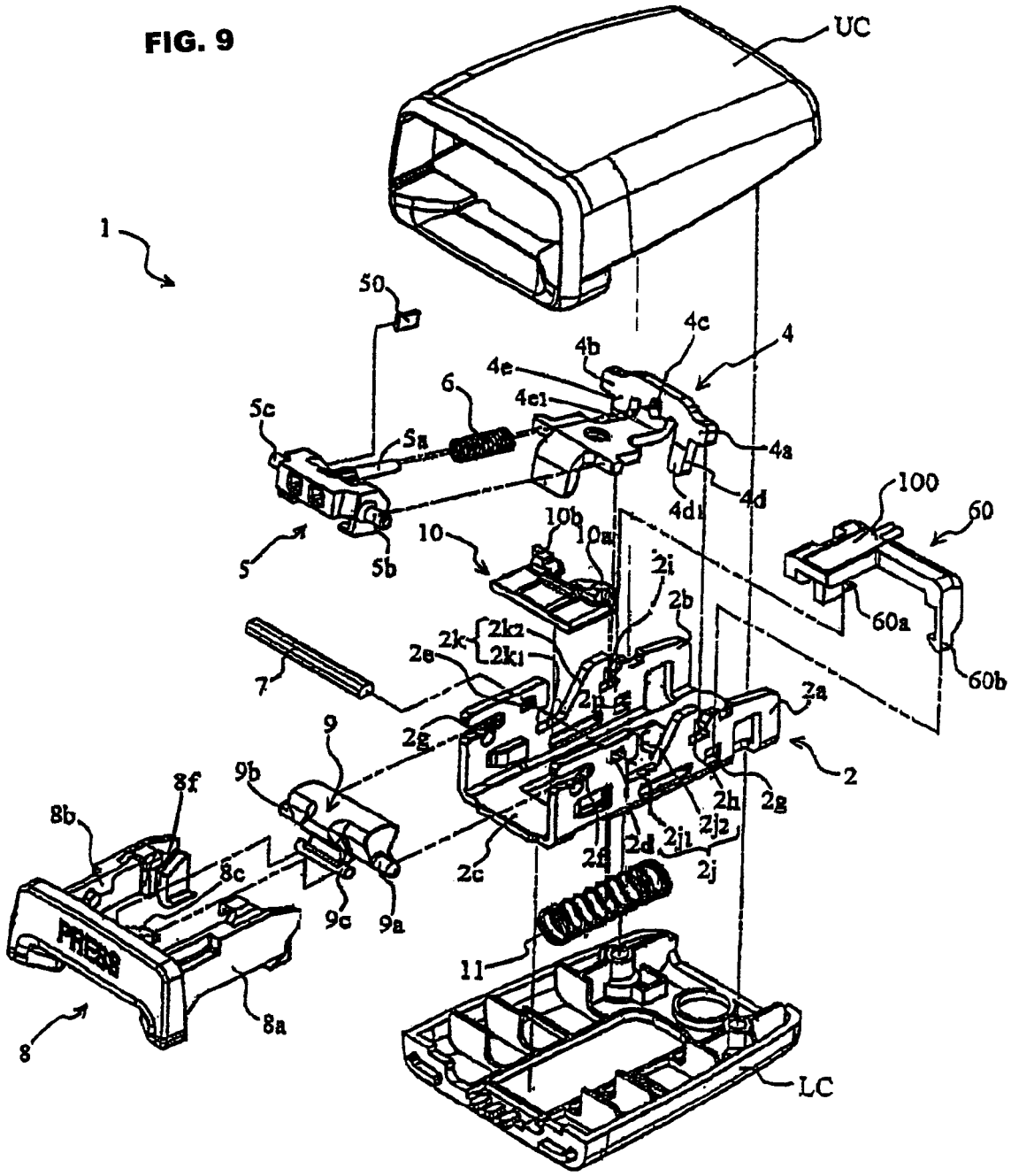
Prior Art FIG. 9
FIG. 9 is an exploded perspective view illustrating an entire structure of the conventional buckle apparatus.

In FIG. 5, a numeral 31 denotes webbing for keeping an occupant under restraint, one end of which is supported by means of an anchor 32 fixed in the vicinity of a floor face of the motor vehicle, and the other end of which is retractably supported by means of a retractor apparatus 33 fixed in the vicinity of the floor face of the motor vehicle; a numeral 34 denotes a shoulder anchor, through which a middle portion of the webbing 31 is inserted, which is rotatably held on a center pillar P of the motor vehicle being situated nearer an upper part thereof, and a numeral 35 denotes a tongue being provided between the anchor 32 and the shoulder anchor 34, positioned at a side opposite to the anchor 32 across a seat 36, and being engageable with a buckle apparatus 40 connected to a predetermined fixation side member 37.

The buckle apparatus 40 is formed into a predetermined housing shape by means of a combination structure of an upper cover 41 and a lower cover 42, both of which constitute a cover as shown in FIG. 1. In addition, a buckle portion 43 to be engaged with the tongue 35 when the tongue 35 is inserted, and an illuminating portion 44 situated nearer an insertion inlet side for the tongue 35 in relation to the buckle portion 43 are provided in an inner part of the buckle apparatus 40.

The buckle 43 is provided with a base 45 that is functionally and substantially identical of the base 2 formed of the U-shaped frame that is explained in Background Art section, and a latch member 46 being rotatably supported at both sides of the base 45 and capable of being latched with the tongue 35. However, a detailed explanation therefor will be omitted here. Further, a shaft 47 to be connected to the fixation side member 37 and an operating member 48 to be used when a releasing operation for locking is performed are provided in the base 45.

The illuminating portion 44 is provided with a pair of LED holding boards 49 which is installed in a standing manner in a vertical (up and down) direction, shown in FIGS. 1 and 2, a flexible lead wire 50 that electrically connects the pair of LED holding boards 49, a switch board 51 that electrically connects the lead wire 50 and a power source at a motor vehicle side (not shown), a reflector (lens) 52 being fixed to a tip end of the switch board 51, which is situated nearer the tongue insertion inlet side in relation to the LED holding board 49. In addition, although the switch board 51 and the LED holding board 49 are electrically connected by means of a lead wire (not shown) or the like, the switch board 51 may be integrally formed with the LED holding board 49.

The LED holding board 49 is held by the lower cover 42 by mere inserting operation. This is because the LED holding board 49 is inserted into a pair of guide groove walls 42*a* formed in the lower cover 42, and the hooking claw 42*b* is hooked with the hooking hole 49*a*, as shown in FIG. 2. Further, a slimline LED light source 53 facing the reflector 52 is provided in the LED holding board 49, as shown in FIGS. 3(*a*) and 3(*b*). Furthermore, in replacement of the slimline LED light source 53, a usual dome-shaped LED light source 54 may be applicable, as shown in FIGS. 4(*a*) and 4(*b*).

In addition, in the above-described embodiment, although the LED holding board 49 is disclosed such that the same is inserted into the pair of guide groove walls 42*a* of the lower cover 42 in the vertical direction, the LED holding board 49 can be constructed to be held by means of the lower cover 42 in a manner so as to be slanted at an angle, such as for example, 45° or 60°, and can be also constructed such that securing of an illuminating direction corresponding to a position and an angle of the buckle apparatus 40 to be disposed in the motor vehicle, does not depend on only the reflector 52. In this case, space saving at a height direction of the LED holding board 49 (thickness of the buckle apparatus 40) can be realized by means of slanting the LED holding board 49. In addition, the LED holding board 49 is not required to be flattened in shape, and for example, the same may be formed by means of inflecting into an substantially L-shape, looking from a side, and may be fixed to the lower cover by a screw or the like. In this case, it is sufficient that at least part of the LED holding board 49 that holds the LED light sources, 53 and 54, is disposed in a vertical direction, in a slanting state at an angle of 45° or 60°, as described above.

Thus, the LED holding boards 49 of the present invention is able to obtain large space at a rear side (at a front right side in FIGS. 1 and 2) thereof because the LED holding board 49 is disposed being situated nearer the tongue insertion inlet of the buckle apparatus 40 at a corner portion in a standing state. As a result, the members in the upper cover 41 and the lower cover 42, other than that described above, such as for example, the detection system such as the aforementioned magnet sensor 100 or the like, the drive system such as the latch member 4, the slider 5, and the like, and etc., are allowed to have a margin for the mounting space therefor, namely the designing flexibility can be improved. Further, at this moment, because a pair of the LED holding boards 49 is electrically connected by means of a flexible lead wire 50, the insertion inlet for the tongue 35 can easily be secured.

What is claimed is:

1. A buckle apparatus comprising:

a base;

a cover extending about the base and having a forward opening portion at one side thereof;

a buckle portion including a latch member pivotally mounted to the base in the cover for being operatively engaged with a tongue of a seat belt inserted in an insertion direction through the opening portion into the cover;

an operating member slidably mounted to the base for being engaged by a user to release the latch member from engagement with the tongue;

a light source for illuminating the opening portion;

a holding board mounted to the cover such that at least a light source holding portion of the holding board for holding the light source is arranged to extend in a predetermined direction that is generally transverse to the insertion direction of the tongue.

2. A buckle apparatus comprising:

a cover having a forward opening portion at one side thereof;

a buckle portion provided in the cover for being operatively engaged with a tongue of a seat belt inserted in an insertion direction through the opening portion into the cover;

a light source for illuminating the opening portion; and a holding board mounted in the cover such that at least a light source holding portion of the holding board for holding the light source is arranged to extend in a predetermined direction that is generally transverse to the insertion direction of the tongue, wherein the holding board is mounted such that the predetermined direction at which the light source holding portion extends is approximately 45° in relation to the insertion direction of the tongue.

3. A buckle apparatus comprising:

a cover having a forward opening portion at one side thereof;

a buckle portion provided in the cover for being operatively engaged with a tongue of a seat belt inserted in an insertion direction through the opening portion into the cover;

a light source for illuminating the opening portion; and a holding board mounted in the cover such that at least a light source holding portion of the holding board for holding the light source is arranged to extend in a predetermined direction that is generally transverse to the insertion direction of the tongue, wherein the holding board is mounted such that the predetermined direction at which the light source holding portion extends is approximately 60° in relation to the insertion direction of the tongue.

4. The buckle apparatus according to claim 1, wherein the holding board is mounted such that the predetermined direction at which the light source holding portion extends is at approximately a right angle in relation to the insertion direction of the tongue.

5. The buckle apparatus according to claim 1, wherein the cover includes a guide groove in which the holding board is mounted.

6. The buckle apparatus according to claim 1, wherein the holding board portion comprises a pair of holding portions for mounting a pair of light sources, respectively, on either side of the opening portion with the holding boards being electrically connected by means of a lead wire.

7. The buckle apparatus according to claim 1, wherein the light source comprises a chip-type LED.

8. A seat belt apparatus including a seat belt for restraining a vehicle occupant in a seat, the seat belt apparatus comprising:

a buckle housing having an interior space, a tongue carried on the seat belt;

a forward insertion opening of the buckle housing;

a latching mechanism in the buckle housing for releasably securing the tongue inserted in a forward to rearward insertion direction into the interior space through the insertion opening with the insertion direction lying in a generally horizontal place in the interior space generally aligned with the insertion opening;

a light source for illuminating the forward insertion opening;

a mounting board for the light source mounted in the buckle housing to extend in a predetermined transverse direction to the horizontal plane adjacent the insertion opening; and a reflector mounted in the buckle housing between the light source and the insertion opening.

9. A seat belt apparatus including a seat belt for restraining a vehicle occupant in a seat, the seat belt apparatus comprising:

a buckle housing having an interior space, a tongue carried on the seat belt;

a forward insertion opening of the buckle housing;

a latching mechanism in the buckle housing for releasably securing the tongue inserted in a forward to rearward insertion direction into the interior space through the insertion opening with the insertion direction lying in a generally horizontal place in the interior space generally aligned with the insertion opening;

a light source for illuminating the forward insertion opening; and a mounting board for the light source that extends in a predetermined transverse direction to the horizontal plane, wherein the mounting board is oriented to extend orthogonal to the horizontal plane adjacent the forward insert opening to maximize size of the interior space for the latching mechanism rearward of the mounting board.

10. A seat belt apparatus including a seat belt for restraining a vehicle occupant in a seat, the seat belt apparatus comprising:

a buckle housing having an interior space, a tongue carried on the seat belt;

a forward insertion opening of the buckle housing;

a latching mechanism in the buckle housing for releasably securing the tongue inserted in a forward to rearward insertion direction into the interior space through the insertion opening with the insertion direction lying in a generally horizontal place in the interior space generally aligned with the insertion opening;

a light source for illuminating the forward insertion opening; and a mounting board for the light source that extends in a predetermined transverse direction to the horizontal plane, wherein the mounting board comprises a pair of mounting boards, and the light source comprises a pair of light sources with each one of the pair of light sources mounted to a respective one of the pair of mounting boards arranged on either side of the insertion opening.

11. The seat belt apparatus of claim 10 wherein the mounting boards include a lead extending therebetween and generally below the insertion opening to electrically interconnect the mounting boards and light sources mounted thereto.

12. A seat belt apparatus including a seat belt for restraining a vehicle occupant in a seat, the seat belt apparatus comprising:

a buckle housing having an interior space, a tongue carried on the seat belt;

a forward insertion opening of the buckle housing;

a latching mechanism in the buckle housing for releasably securing the tongue inserted in a forward to rearward insertion direction into the interior space through the insertion opening with the insertion direction lying in a generally horizontal place in the interior space generally aligned with the insertion opening;

a light source for illuminating the forward insertion opening; and a mounting board for the light source that extends in a predetermined transverse direction to the horizontal plane, wherein the predetermined transverse direction in which the mounting board extends is at an angle of approximately 45° to the horizontal plane to divide the forward and rearward adjacent areas about the mounting board equally in the buckle interior space.

13. A seat belt apparatus including a seat belt for restraining a vehicle occupant in a seat, the seat belt apparatus comprising:

a buckle housing having an interior space, a tongue carried on the seat belt;

a forward insertion opening of the buckle housing;

a latching mechanism in the buckle housing for releasably securing the tongue inserted in a forward to rearward insertion direction into the interior space through the insertion opening with the insertion direction lying in a generally horizontal place in the interior space generally aligned with the insertion opening;

a light source for illuminating the forward insertion opening; and a mounting board for the light source that extends in a predetermined transverse direction to the horizontal plane, wherein the predetermined transverse direction in which the mounting board extends is at an angle of approximately 60° to the horizontal plane to increase size of the interior space adjacent the mounting board rearwardly therefrom.

14. A seat belt apparatus including a seat belt for restraining a vehicle occupant in a seat, the seat belt apparatus comprising:

a buckle housing having an interior space, a tongue carried on the seat belt;

a forward insertion opening of the buckle housing;

a latching mechanism in the buckle housing for releasably securing the tongue inserted in a forward to rearward insertion direction into the interior space through the insertion opening with the insertion direction lying in a generally horizontal place in the interior space generally aligned with the insertion opening;

a light source for illuminating the forward insertion opening; and a mounting board for the light source that extends in a predetermined transverse direction to the horizontal plane, wherein the mounting board has portions that extend transversely to each other and one of the portions comprises a mounting portion to which the light source is secured with the mounting portion extending transverse to the horizontal plane.

15. A lighted buckle apparatus comprising:

a buckle housing having an interior space in which buckle operating components are disposed;

a forward insertion opening of the buckle housing for receiving a tongue inserted in a predetermined forward to rearward insertion direction therein and into the interior space;

a light source for illuminating the forward insertion opening;

a mounting member in the interior space;

at least a portion of the mounting member having a generally flat, planar configuration with the light source mounted thereto; and opposite ends of the mounting member portion with the mounting member being oriented in the interior space so that the opposite ends of the mounting member portion are spaced from each other in a substantially linear, predetermined direction that extends transverse to the insertion direction.

16. The lighted buckle apparatus of claim 15 wherein the mounting member portion is adjacent the insertion opening, and the opposite ends of the mounting member portion are aligned with each other in the forward to rearward insertion direction for maximizing size of the interior space rearwardly of the mounting member portion for the buckle operating components.

17. The lighted buckle apparatus of claim 15 wherein the buckle housing comprises upper and lower cover members connected to form the interior space, and the opposite ends of the mounting member portions including a lower, forward end and a higher, rearward end for maximizing size of the interior space in the lower cover member for the buckle operating components.

18. The lighted buckle apparatus of claim 15 wherein the light source comprises a pair of light sources, and the mounting member portion comprises a pair of mounting member portions on either side of the insertion opening with each one of the pair of light sources mounted to a respective one of the pair of mounting member portions.

* * * * *